United States Patent [19]

Meyer

[11] Patent Number: 4,524,262

[45] Date of Patent: Jun. 18, 1985

[54] ELECTRICALLY HEATED SEWER VENT LINE DEFROSTER

[76] Inventor: Cyril G. Meyer, 830 7th St. South, Breckenridge, Minn. 56520

[21] Appl. No.: 462,400

[22] Filed: Jan. 31, 1983

[51] Int. Cl.[3] ..... H05B 1/00

[52] U.S. Cl. ..... 219/213; 4/218; 4/219; 52/219; 98/45; 98/58; 98/60; 137/297; 138/33; 219/280; 219/301; 219/359; 219/535

[58] Field of Search ..... 219/280, 281, 301, 535, 219/374, 359, 381, 213; 4/218, 221; 98/45–48, 58–60; 138/33; 137/301, 297; 52/218, 219

[56] References Cited

U.S. PATENT DOCUMENTS

| | | | |
|---|---|---|---|
| 387,134 | 7/1888 | Benson et al. | 4/221 |
| 745,682 | 12/1903 | Shoenberg | 219/301 |
| 749,769 | 1/1904 | Wilson | 219/374 X |
| 917,385 | 4/1909 | Wallace | 4/218 |
| 921,752 | 5/1909 | Ulrich et al. | 4/218 X |
| 1,426,187 | 8/1922 | Harrison | 219/280 |
| 1,759,830 | 5/1930 | Blanchard | 219/280 |
| 3,120,600 | 2/1964 | True | 219/301 |
| 4,110,603 | 8/1978 | Peterson et al. | 138/33 X |

FOREIGN PATENT DOCUMENTS

| | | | |
|---|---|---|---|
| 110167 | 1/1968 | Denmark | 219/301 |
| 206118 | 7/1924 | United Kingdom | 219/381 |

*Primary Examiner*—A. Bartis

*Attorney, Agent, or Firm*—Williamson, Bains, Moore & Hansen

[57] ABSTRACT

A plastic sewer vent line extending through the roof of a building is provided with a defroster for preventing blockage of the vent line by freezing and the consequent back-up sewage gas into the building. The defroster is located above the roof and includes a metal pipe, e.g., of copper, having its bottom end coupled to the plastic sewer vent line and provided with an electric heating coil in contact with a portion of the exterior thereof. An outer shell is spaced outwardly from and surrounds the exterior of the pipe and has a top sealed to the pipe top and a bottom sealed to the roof to provide an annular providing an insulating effect and enhancing the effectiveness of the heating element. A heat limiting switch is provided to prevent overheating.

4 Claims, 2 Drawing Figures

ELECTRICALLY HEATED SEWER VENT LINE DEFROSTER

BACKGROUND OF THE INVENTION

In cold climates, there has long been a problem with the freezing of sewer vent pipes. These pipes extend upwardly through a roof and tend to freeze over at the upward end thereof, thereby causing sewage gas to back up in the house, to the detriment of the occupants thereof. In the past, pipe heaters of various sorts have been well-known for assisting in defrosting. Such heaters may take the form of tapes or the like, but due to the nature and the amount of heat involved are generally limited to the metallic pipes. At least one plastic pipe heater is known as typified in U.S. Pat. No. 4,110,603, which shows the heating element spaced slightly from the plastic pipe for defrosting purposes. However, none of these prior defrosting devices are truly suitable for a plastic pipe which generally extends upwardly from a roof line.

SUMMARY OF THE INVENTION

A plastic sewer vent pipe generally extends upwardly through the roof of a house. The vent pipe is then cut off approximately even with the roof line and a plastic coupling bonded in place over the end thereof. Inserted into the plastic coupling is a copper pipe element which extends upwardly the desired distance. A Calrod heating element is placed about the copper pipe and connected to a source of electricity which may be manually controlled or may be controlled by means of a timer or the like. Also provided is a high limit switch to prevent overheating of the heating element and pipe. The copper pipe is surrounded by an outer shell which is spaced outwardly from the copper pipe providing an annular heating space therebetween. The provision of this space allows a much smaller heating element to be used than might otherwise be thought necessary. The annular space serves to insulate and also allow the portion of the metallic pipe not contacted by the element to be efficiently heated by conduction and convection. The shell is sealed to the top of the copper pipe at the top and to the roof at the bottom, thereby essentially weather proofing the heating space therebetween to enhance the insulating effect thereof.

These and other objects and advantages of my invention will appear more fully from the following description made in conjunction with the accompanying drawings wherein like reference characters refer to the same or similar parts throughout the several views.

DESCRIPTION OF THE DRAWING FIGURES

FIG. 1 is a perspective view showing the invention mounted on a building; and FIG. 2 is a cross-sectional view taken along line 2—2 of FIG. 1.

DESCRIPTION OF THE PREFERRED EMBODIMENT

Figure 1:
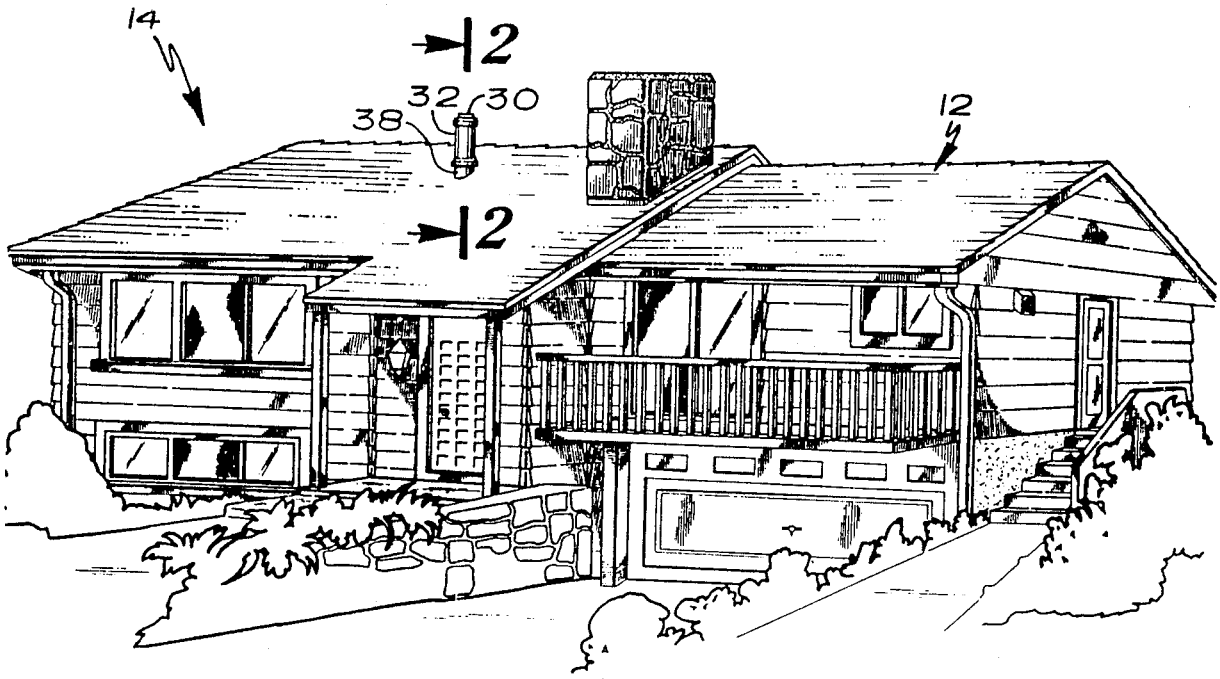
Figure 2:
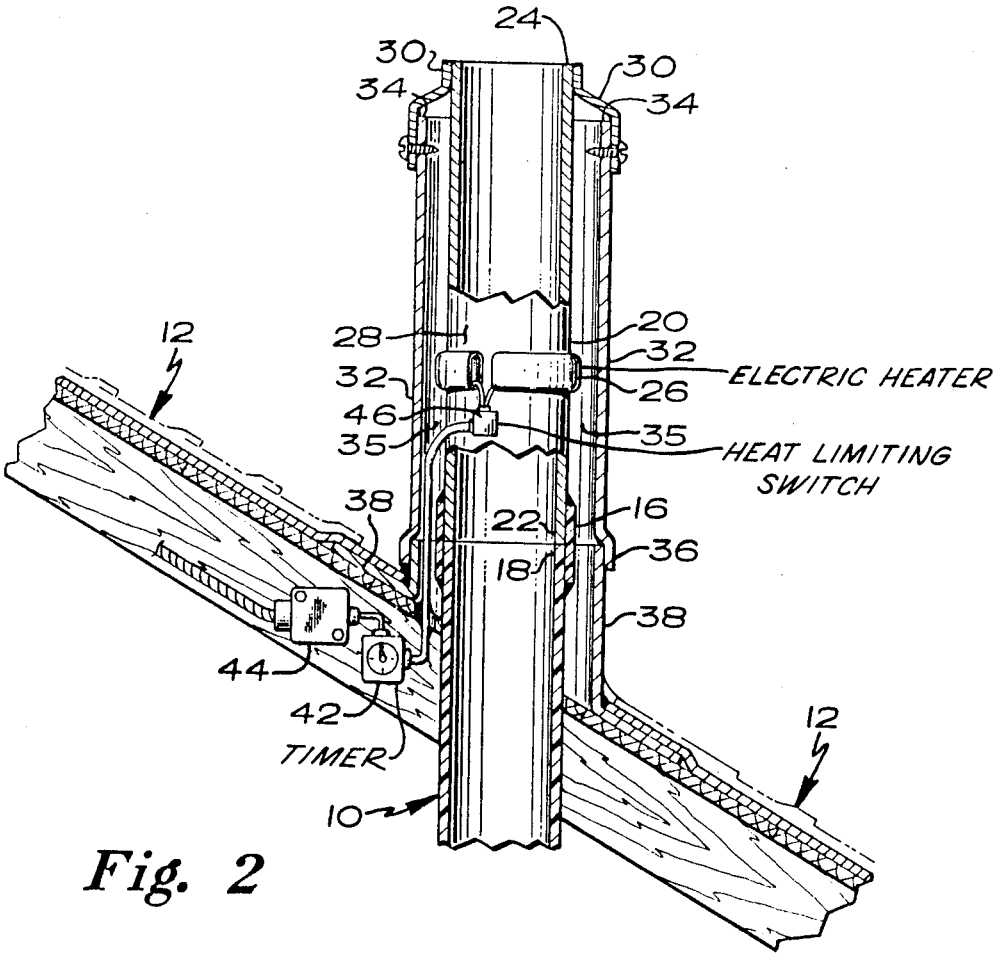

A sewer vent pipe 10, generally made of plastic, extends through the roof 12 of a building 14. In practice of the instant invention, the portion of vent pipe 10 extending beyond roof 12 is cut off at and slightly above the roof line and a coupling 16 adhesively bonded over the upper end 18 of the pipe 10. A metallic pipe 20 having a lower end 22 and an upper end 24 has the lower end 22 thereof inserted into coupling 16 where it is also fastened by means of adhesive bonding or other known procedures. Metallic vent pipe 20 is surrounded at approximately its midpoint by heating element 26. Heating element 26 may be of any known type. Heating element 26 need only cover a small portion of the exterior 28 of metallic vent pipe 20, as will be more fully explained hereinafter. A sealing cap 30 is sealed to the top end 24 of vent pipe 20 and to the upper end 34 of outer shield 32. Outer shield 32 is coaxial with and spaced outwardly from metallic vent pipe 20, thereby defining an annular space 35 therebetween. Annular space 35 provides an insulating effect, thereby substantially enhancing the heating effect of heating element 26 and allowing the use of a relatively small heating element 26 as compared to the length of the vent pipe element 20. Outer shield 32 has a coupling flange 36 at the lower end thereof which is in turn engaged to adapter 38 which is in turn sealed to roof 12 by conventional means.

Heating element 26 is connected to a timer 42 which is in turn connected to a source of power 44. A heat limiting switch 46 is incorporated on pipe 20 adjacent element 26 in order to prevent overheating of the pipe 20. It can be appreciated that, rather than a timer 42, heating element 26 may also be controlled manually, or indeed, by means of a temperature sensor which would be capable of sensing an icing condition within pipe 20.

While the preferred embodiments of the present invention have been described, it should be understood that various changes, adaptions and modifications may be made therein without departing from the spirit of the invention and the cope of the appended claims.

I claim:

1. A vent line defroster in combination with a plastic sewer vent line extending through a roof, said defroster being located above said roof and comprising:

a metal pipe having an exterior, a top and a bottom;

a heating element contacting at least a portion of said exterior of said pipe;

means for coupling the bottom of said pipe to said plastic sewer vent line; and an outer shell having a top and a bottom surrounding and spaced outwardly from said pipe, said shell top being sealed to said pipe top and said shell bottom being sealed to said roof.

2. The combination of claim 1 further comprising a heat limiting switch for control of said heating element.

3. The combination of claim 1 wherein said portion is substantially less than the full extent of said exterior.

4. The combination of claim 1 wherein said pipe is copper.

* * * * *